US005519949A

United States Patent [19]

Gibson, Jr.

[11] Patent Number: 5,519,949

[45] Date of Patent: May 28, 1996

[54] CLOTHES DRYER AND TUMBLE-PREVENTING MEANS FOR USE WITH A CLOTHES DRYER

[76] Inventor: Pressley T. Gibson, Jr., 246 Hillcrest Ave., Rock Hill, S.C. 29732

[21] Appl. No.: 322,593

[22] Filed: Oct. 13, 1994

[51] Int. Cl.[6] ..... F26B 11/02

[52] U.S. Cl. ..... 34/600; 34/604; 34/109

[58] Field of Search ..... 34/595, 599, 600, 34/603, 604, 108, 109, 239

[56] References Cited

U.S. PATENT DOCUMENTS

| | | | |
|---|---|---|---|
| 3,316,659 | 5/1967 | Lauck . | |
| 3,344,532 | 10/1967 | Bigler | 34/600 |
| 4,091,548 | 5/1978 | Daily | 34/202 |
| 4,109,397 | 8/1978 | Daily | 34/600 |
| 4,338,739 | 6/1983 | Martinon et al. . | |
| 4,617,743 | 10/1986 | Barnard | 34/600 |
| 4,677,760 | 7/1987 | St. Louis | 34/90 |
| 4,813,641 | 3/1989 | Wilson . | |
| 5,220,734 | 6/1993 | Carver . | |
| 5,276,949 | 1/1994 | Gordon, Sr. | 34/600 |
| 5,333,393 | 8/1994 | Hill et al. . | |

OTHER PUBLICATIONS

Harriet Carter, p. 93.

*Primary Examiner*—Denise L. Gromada
*Attorney, Agent, or Firm*—W. Thad Adams, III

[57] ABSTRACT

An improved clothes dryer includes a heated drying chamber, a drum mounted for rotation in the drying chamber to tumble articles of clothing, and a door which is opened to permit placement and removal of articles in the dryer and is closed during the drying process. The improvement is tumble-preventing means for positioning an article in the drying chamber for drying without tumbling. The tumble-preventing means includes a clothes bag for being trapped between the dryer door and the drying chamber for restraining in the drying chamber the article to be dried. The clothes bag positions the article at a height within the drying chamber sufficient to prevent rotation-causing contact between the article and the rotating drum. A locking clip is located outside of the dryer for being attached to the clothes bag. The locking clip prevents the clothes bag from being dislodged by rotation of the drum from its trapped condition between the dryer door and drying chamber during the drying process.

6 Claims, 4 Drawing Sheets

CLOTHES DRYER AND TUMBLE-PREVENTING MEANS FOR USE WITH A CLOTHES DRYER

TECHNICAL FIELD AND BACKGROUND OF THE INVENTION

This invention relates to an improved clothes dryer and tumble-preventing means for use with a clothes dryer. The invention serves to position an article to be dried, such as a shoe or pair of shoes, at a sufficient height above a rotating drum of the dryer to prevent the article from tumbling within the heated drying chamber.

Several prior art devices address some of the problems associated with drying shoes in a conventional clothes dryer. Since wet shoes are relatively heavy, they create a loud noise when allowed to tumble freely within the dryer. The violent tumbling of the shoes may cause damage to both the dryer and the shoes. In addition, the shoes often cause the dryer door to knock open, thus turning off operation of the dryer.

According to one prior art device, a single shoe is attached to a suction cup which is secured by suction to the rotating drum of the dryer. During the drying process, the suction cup is intended to hold the shoe in the drying chamber without tumbling.

This prior art device suffers from disadvantages. Since the dryer door is closed during operation of the dryer, it is often difficult to determine whether the suction cup and shoe are remaining properly attached during drying. Moreover, other articles of clothing being dried together with the shoe will tend to dislodge the shoe and suction cup from their secured position within the drying chamber.

According to another prior art device, a clothes rack or basket is mounted within the drying chamber of the dryer to restrain a shoe or other article to be dried. This device makes it difficult to dry other articles of clothing together with the restrained article. In addition, the device may cause damage to the dryer, and the other articles of clothing being dried.

The present invention overcomes many disadvantages of the prior art by providing tumble-preventing means which will neither damage the dryer, nor will it obstruct or damage other articles of clothing being dried together with the restrained article. The present invention is secured to the dryer at a point which can be readily observed by a user. Thus, the user is not required to periodically open the dryer door to determine if the article is remaining properly restrained during the drying process. Moreover, the present invention helps maintain the dryer door in the closed position during operation of the dryer.

SUMMARY OF THE INVENTION

Therefore, it is an object of the invention to provide an improved dryer which includes tumble-preventing means for positioning an article to be dried at a sufficient height above a rotating drum of the dryer to prevent the article from tumbling within the heated drying chamber.

It is another object of the invention to provide tumble-preventing means for use with a clothes dryer.

It is another object of the invention to provide tumble-preventing means which eliminates the loud noise caused by tumbling of wet, relatively heavy articles within the drying chamber of a clothes dryer.

It is another object of the invention to provide tumble-preventing means which prevents the dryer door from banging open during operation of the dryer.

It is another object of the invention to provide tumble-preventing means which is secured to the dryer at a point readily observable by a user without opening the dryer door.

These and other objects of the present invention are achieved in the preferred embodiments disclosed below by providing an improved clothes dryer having a heated drying chamber, a drum mounted for rotation in the drying chamber to tumble articles of clothing, and a door which is opened to permit placement and removal of articles in the dryer and is closed during the drying process. The improvement includes tumble-preventing means for positioning an article in the drying chamber for drying without tumbling. The tumble-preventing means includes restraint means for being trapped between the dryer door and the drying chamber for restraining in the drying chamber the article to be dried. The restraint means positions the article at a height within the drying chamber sufficient to prevent rotation-causing contact between the article and the rotating drum.

Locking means is located outside of the dryer for being attached to the restraint means. The locking means prevents the restraint means from being dislodged by rotation of the drum from its trapped condition between the dryer door and drying chamber during the drying process.

According to another preferred embodiment of the invention, the restraint means is a clothes bag for containing the article to be dried.

According to another preferred embodiment of the invention, the clothes bag is constructed of an open-mesh cloth material.

According to yet another preferred embodiment of the invention, the clothes bag includes an opening therein to permit placement and removal of the article into the clothes bag, and a zipper located at the opening for sealing the opening.

According to yet another preferred embodiment of the invention, the locking means is a removable clip for being inserted through the restraint means. The clip resides outside of the dryer for preventing the restraint means from being dislodged from its trapped condition and pulled into the drying chamber during the drying process.

According to yet another preferred embodiment of the invention, the clip is a plastic comb having a plurality of teeth for being inserted through the restraint means.

According to yet another preferred embodiment of the invention, the article includes a shoe.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
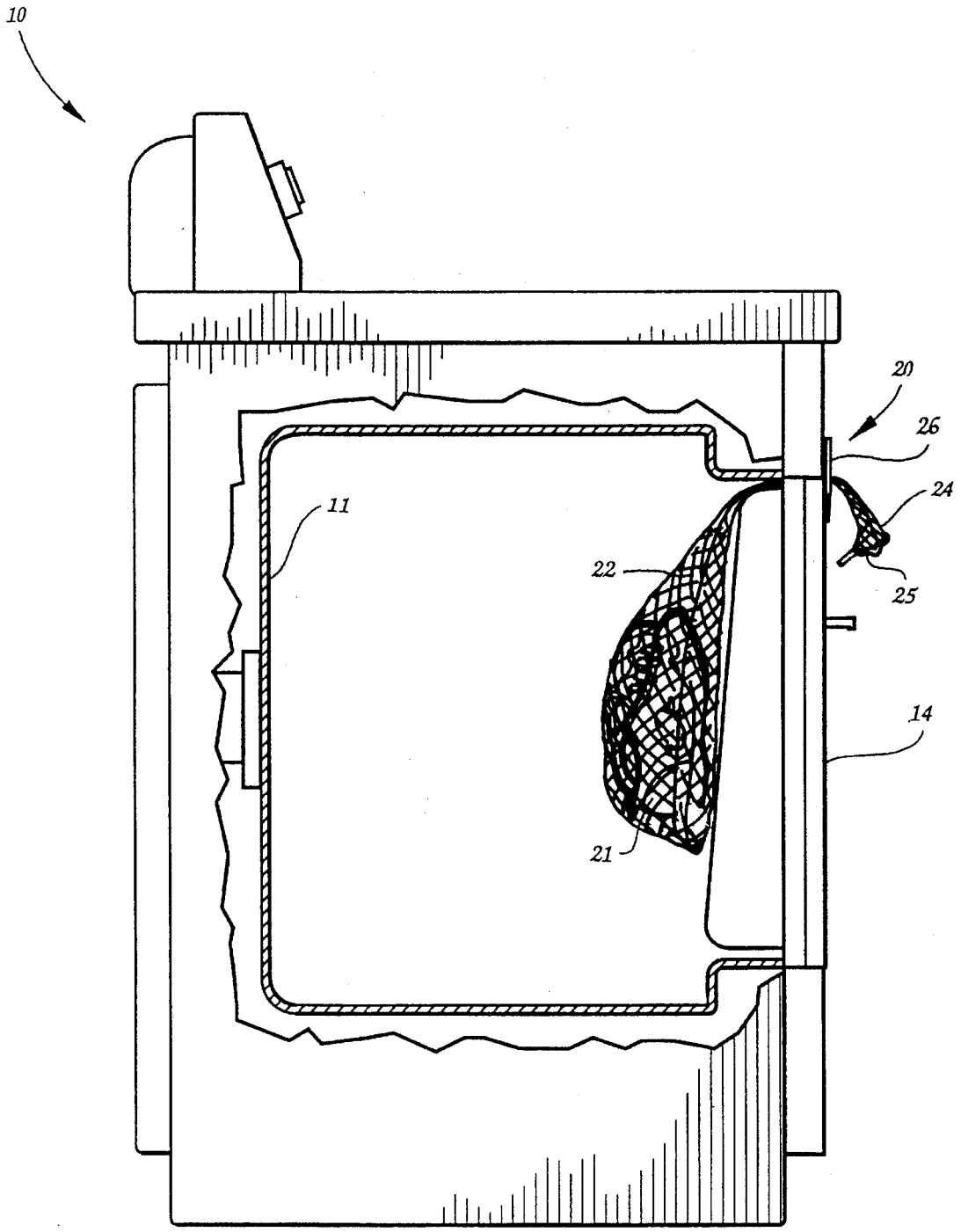
FIG. 1 is a side elevation of the clothes dryer with a side wall broken away to illustrate the position of the bag and article within the drying chamber during the drying process.

Referring now specifically to the drawings, an improved clothes dryer according to the present invention is illustrated in FIG. 1 and shown generally at reference numeral 10. The clothes dryer 10 includes conventional elements, such as a heated drying chamber 11, a drum 12 mounted for rotation in the drying chamber 11 to tumble articles of clothing, and a pivoted door 14. The door 14 is opened to permit placement and removal of articles in the dryer 10 and is closed during the drying process.

The improvement in the dryer 10 is the provision of tumble-preventing means 20. The tumble-preventing means 20 positions an article 21, such as a shoe or pair of shoes, in the drying chamber 11 for drying without tumbling.

Figure 2:
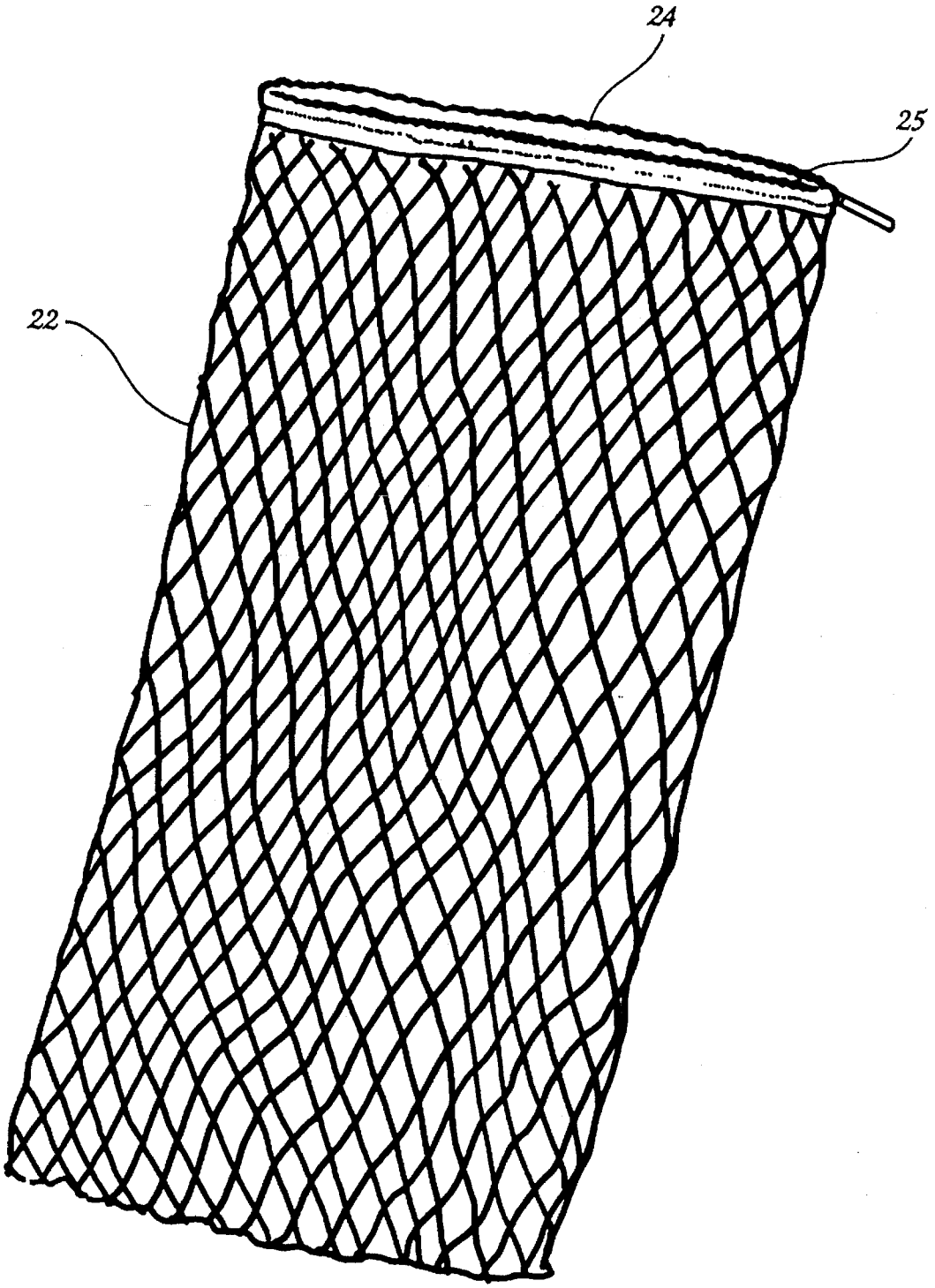
FIG. 2 is a perspective view of the bag according to one embodiment of the invention.

As shown in FIGS. 1 and 2, the tumble-preventing means 20 preferably includes an open-mesh, cloth bag 22 for containing the article 21 to be dried. During operation of the dryer 10, the bag 22 is trapped between the dryer door 14 and the drying chamber 11, and serves to position the article 21 at a height within the drying chamber 11 sufficient to prevent rotation-causing contact between the article 21 and the rotating drum 12. Preferably, the bag 22 maintains the article 21 at a height of between 2 and 6 inches above the rotating drum 12.

In addition, the bag 22 includes an opening 24 for permitting placement and removal of the article 21 into the bag 22. A zipper 25 is preferably located at the opening 24 of the bag 22 for sealing the opening 24 and containing the article 21 within the bag 22 during the drying process. In an alternative embodiment (not shown), the bag includes draw strings for closing the opening of the bag during operation of the dryer.

Figure 3:
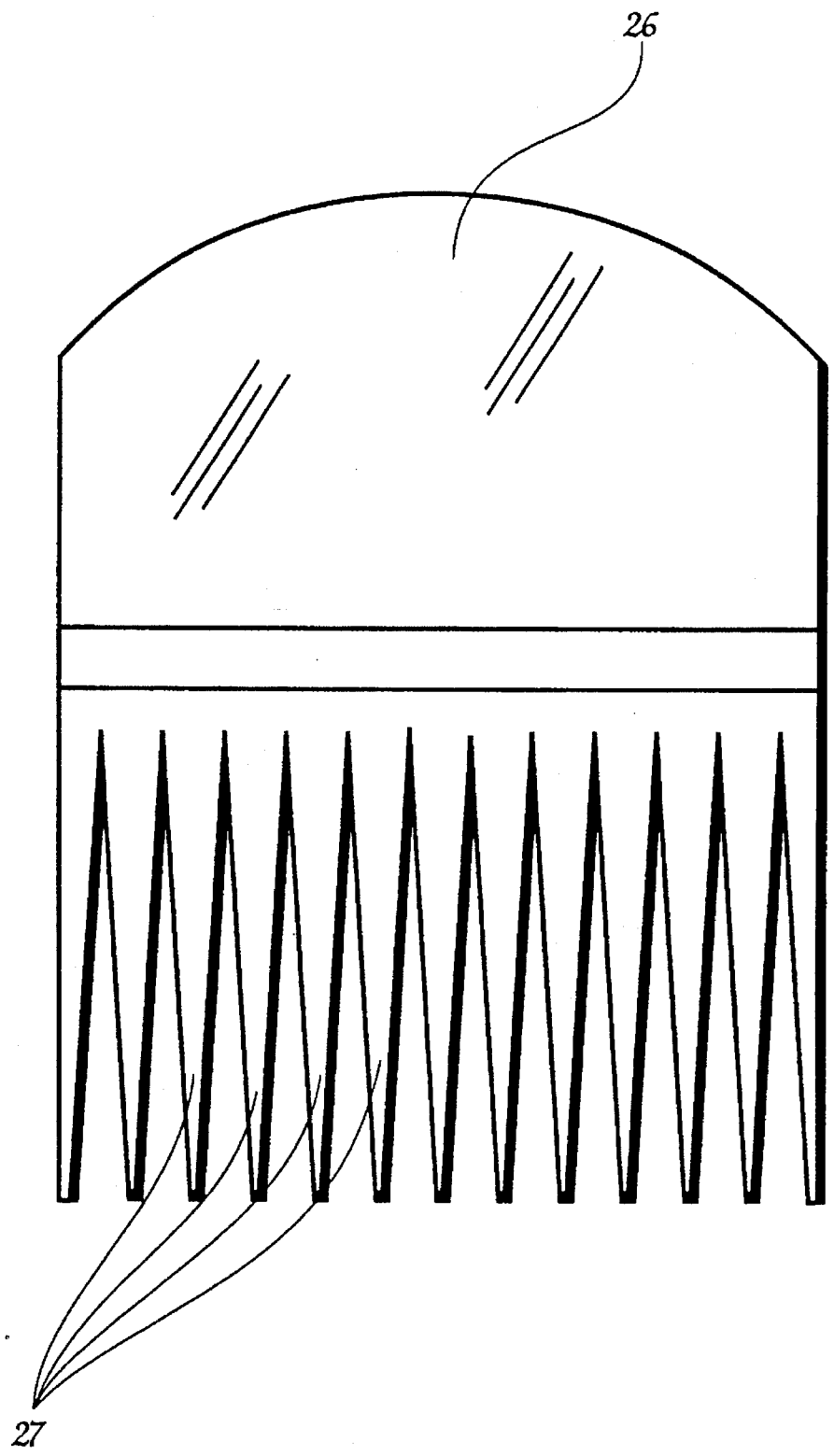
FIG. 3 is a front elevation of the clip according to one embodiment of the invention.
Figure 4:
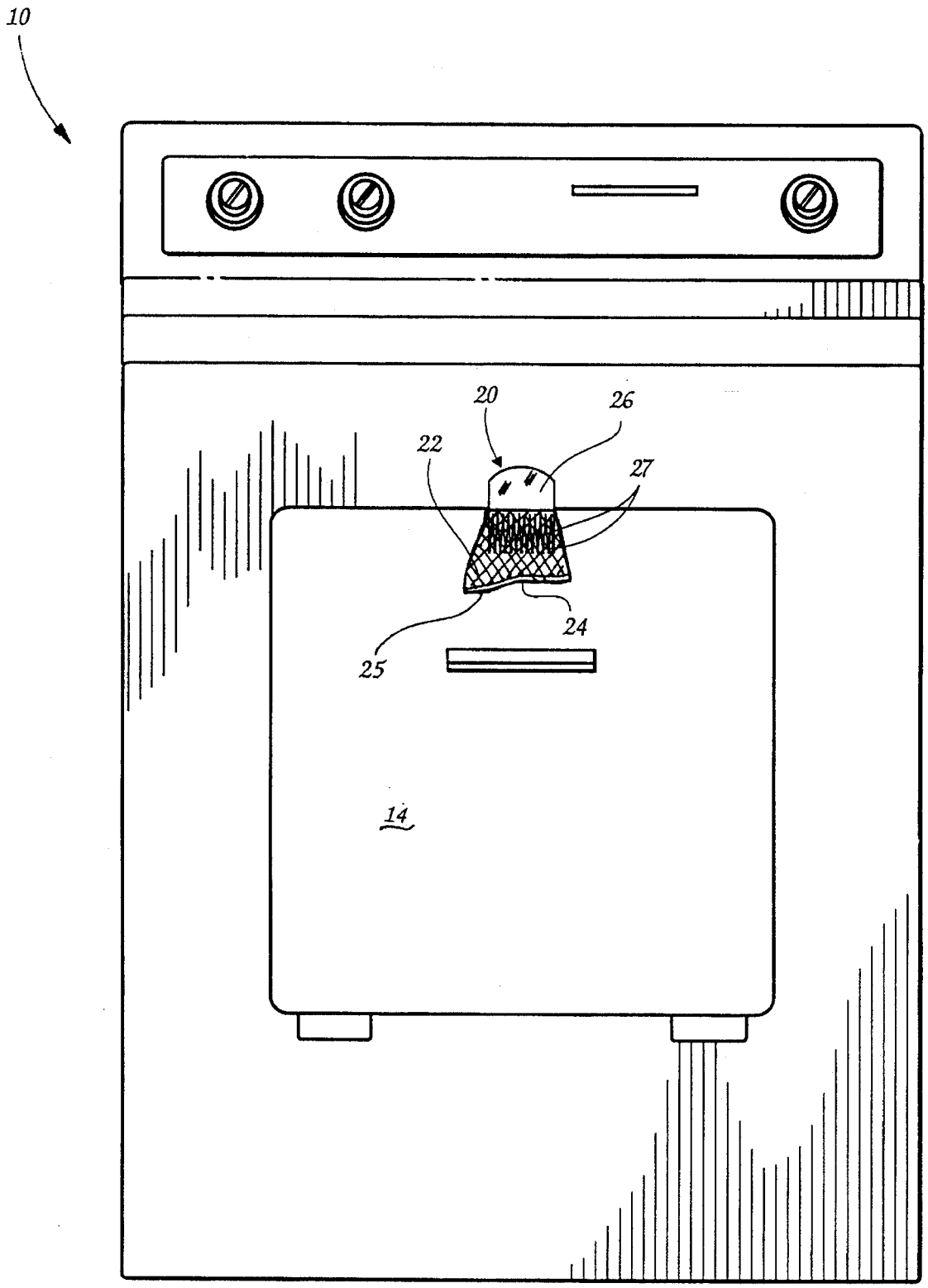
FIG. 4 is a front elevation of the dryer with the door closed, and showing the attachment outside of the dryer of the clip to the bag.

Referring to FIGS. 1, 3 and 4, the tumble-preventing means 20 further includes a removable plastic clip 26 located outside of the dryer 10 for being attached to the bag 22. The clip 26 engages the dryer 10, and prevents the bag 22 from being dislodged by rotation of the drum 12 from its trapped condition between the dryer door 14 and drying chamber 11 during the drying process. Preferably, the clip 26 is flat, and includes a plurality of teeth 27 for being inserted through the mesh openings of the bag 2. The attachment of the clip 26 to the bag 22 is best shown in FIG. 4.

Thus, to secure the bag 22 to the dryer 10 for drying of the article 21, the dryer door 14 is first opened, and a portion of the bag 22 is located over a top edge of the dryer door 14. The dryer door 14 is then pivoted to the closed position, as in FIGS. 1 and 4, and the bag 22 becomes trapped between the door 14 and the drying chamber 11. Finally, the clip 26 is inserted through the mesh openings of the bag 22, and engages the dryer 10 to prevent the bag 22 from being pulled into the drying chamber 11 during the drying process. Moreover, the pulling force of the clip 26 acting on the dryer door 14 prevents the door 14 from banging open during operation of the dryer 10.

An improved clothes dryer and tumble-preventing means for use with a clothes dryer is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. In combination with a clothes dryer having a heated drying chamber, a drum mounted for rotation in the drying chamber to tumble articles of clothing, and a door which is opened to permit placement and removal of articles in the dryer and is closed during the drying process, the improvement comprising tumble-preventing means for positioning an article in the drying chamber for drying without tumbling, said tumble-preventing means comprising:

(a) restraint means comprising a clothes bag for being trapped between the dryer door and the drying chamber for restraining in the drying chamber the article to be dried, said clothes bag positioning the article at a height within the drying chamber sufficient to prevent rotation-causing contact between the article and the rotating drum; and (b) locking means comprising a removable clip for being attached to said clothes bag, and residing outside of the drying chamber for preventing said clothes bag from being dislodged by rotation of the drum from its trapped condition between the dryer door and drying chamber during the drying process.

2. An clothes dryer according to claim 1, wherein said clothes bag includes an opening therein to permit placement and removal of the article into the clothes bag, and a zipper located at the opening for sealing the opening.

3. An clothes dryer according to claim 1, wherein said clothes bag is constructed of an open-mesh cloth material and said clip is constructed of plastic, said clip including a plurality of teeth for being inserted into and through the mesh of said clothes bag.

4. Tumble-preventing means for use with a clothes dryer having a heated drying chamber, a drum mounted for rotation in the drying chamber to tumble articles of clothing, and a door which is opened to permit placement and removal of articles in the dryer and is closed during the drying process, said tumble-preventing means for positioning articles in the drying chamber for drying without tumbling, said tumble-preventing means comprising:

(a) restraint means comprising a clothes bag for being trapped between the dryer door and the drying chamber for restraining in the drying chamber the article to be dried, said clothes bag positioning the article at a height within the drying chamber sufficient to prevent rotation-causing contact between the article and the rotating drum; and (b) locking means comprising a removable clip for being attached to said clothes bag, and residing outside of the drying chamber for preventing said clothes bag from being dislodged by rotation of the drum from its trapped condition between the dryer door and drying chamber during the drying process.

5. Tumble-preventing means according to claim 4, wherein said clothes bag includes an opening therein to permit placement and removal of the article into the clothes bag, and a zipper located at the opening for sealing the opening.

6. Tumble-preventing means according to claim 4, wherein said clothes bag is constructed of an open-mesh cloth material and said clip is constructed of plastic, said clip including a plurality of teeth for being inserted into and through the mesh of said clothes bag.

* * * * *